US009367012B2

(12) United States Patent
Miyajima

(10) Patent No.: US 9,367,012 B2
(45) Date of Patent: Jun. 14, 2016

(54) PRINTING APPARATUS HAVING A SHEET STORAGE UNIT THAT STORES A SHEET ON WHICH AN IMAGE HAS BEEN PRINTED, PRINTING METHOD, AND STORAGE MEDIUM

(71) Applicant: CANON KABUSHIKI KAISHA, Tokyo (JP)

(72) Inventor: Jun Miyajima, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/732,522

(22) Filed: Jun. 5, 2015

(65) Prior Publication Data

US 2015/0355589 A1 Dec. 10, 2015

(30) Foreign Application Priority Data

Jun. 9, 2014 (JP) ..... 2014-119016

(51) Int. Cl.
*G03G 15/00* (2006.01)
*B65H 1/00* (2006.01)

(52) U.S. Cl.
CPC ..... *G03G 15/5091* (2013.01); *B65H 1/00* (2013.01); *G03G 15/6538* (2013.01); *G03G 2215/00675* (2013.01); *G03G 2215/00911* (2013.01)

(58) Field of Classification Search
CPC ..... G03G 15/5091
USPC ..... 399/80, 82, 83
See application file for complete search history.

(56) References Cited

U.S. PATENT DOCUMENTS 6,421,582 B1 * 7/2002 Wada ..... G03G 15/6538 399/80
7,764,922 B2 * 7/2010 Sasama ..... G03G 15/6552 399/361
8,351,811 B2 * 1/2013 Ishio et al. ..... G03G 15/6552 399/80
9,156,645 B2 * 10/2015 Tsuji et al. ..... B65H 31/3081

FOREIGN PATENT DOCUMENTS

JP 2013-220905 A 10/2013

* cited by examiner

*Primary Examiner* — William J Royer
(74) *Attorney, Agent, or Firm* — Canon USA. Inc. IP Division

(57) ABSTRACT

A printing apparatus prints, on a sheet, an image for one page or a plurality of pages, stores a sheet on which an image has been printed inside the printing apparatus, discharges a sheet on which an image has been printed outside the printing apparatus without storing the sheet, saves, in a case where a sheet is not storable, data corresponding to a page to be printed on the sheet, and performs, upon receipt of a printed sheet taking-out instruction, control to convey a stored sheet so that at least a part of the sheet is exposed outside of the printing apparatus, to print an image based on saved data, and to discharge the sheet on which the image has been printed outside the printing apparatus.

20 Claims, 11 Drawing Sheets

FIG. 8

800

| JOB ID | USER ID | RECEPTION DATE AND TIME | STORAGE UNIT ID | SAVING INFORMATION |
|---|---|---|---|---|
| 001 | aaa | 20140101_1230 | 201 | – |
| 002 | bbb | 20140102_1030 | 202 | PRESENT |
| 003 | ccc | 20140102_1230 | 203 | – |
| 004 | ddd | 20140102_1330 | – | PRESENT |
| 005 | eee | 20140103_1830 | – | PRESENT |

PRINTING APPARATUS HAVING A SHEET STORAGE UNIT THAT STORES A SHEET ON WHICH AN IMAGE HAS BEEN PRINTED, PRINTING METHOD, AND STORAGE MEDIUM

BACKGROUND

1. Field

Aspects of the present invention generally relate to a printing apparatus, a printing method, and a storage medium, for printing an image on a sheet.

2. Description of the Related Art

Conventionally, printing apparatuses print images on sheets, and then discharge the sheets (printed sheets) outside the printing apparatuses after printing. Further, in recent years, there has been proposed a mechanism for temporarily keeping a printed sheet inside an apparatus, without immediately discharging the printed sheet to outside of the apparatus after printing.

Japanese Patent Application Laid-Open No. 2013-220905 discusses a printing apparatus that includes a plurality of sheet storage units therein, and temporarily stores a printed sheet in any one of the plurality of sheet storage units. This printing apparatus has a function of authenticating a user, so that, among printed sheets stored in the plurality of sheet storage units, a printed sheet corresponding to an authenticated user is conveyed to be partially exposed outside the printing apparatus. The user then can pull out the partially exposed printed sheet, to receive the user's own printed sheet.

With such a configuration, working efficiency can be improved by starting printing before the user arrives at a setup location of the printing apparatus, while preventing leakage of confidential information that occurs if the printed sheet is seen by other people.

There is an upper limit to the number of sheets storable in each of the sheet storage units provided in such a printing apparatus. Therefore, when a print job including more than one page is executed, the sheet storage unit may become full in the middle of executing the job. In addition, the size of a sheet storable in the sheet storage unit may be limited more than the size of a sheet printable by the printing apparatus, due to the structure of the sheet storage unit or the structure of a sheet-conveying path to the sheet storage unit.

According to Japanese Patent Application Laid-Open No. 2013-220905, the printing apparatus includes, separately from the plurality of sheet storage units provided inside the printing apparatus, a configuration for immediately discharging a printed sheet outside the printing apparatus (without requiring user authentication). However, if a printed sheet that cannot be stored in the sheet storage unit is immediately discharged outside the printing apparatus, the discharged printed sheet can be seen by other people and therefore, there is a risk of confidential information leakage.

SUMMARY

Aspects of the present invention are generally directed to a printing apparatus, a printing method, and a storage medium, capable of suitably utilizing a sheet storage unit provided inside the printing apparatus, while appropriately protecting confidential information.

According to an aspect of the present invention, a printing apparatus includes a printing unit configured to print, on a sheet, an image for one page or a plurality of pages, a sheet storage unit configured to store a sheet on which an image has been printed, inside the printing apparatus, a discharge unit configured to discharge a sheet on which an image has been printed outside the printing apparatus, without storing the sheet in the sheet storage unit, a saving unit configured to save, in a case where a sheet is not storable in the sheet storage unit, data corresponding to a page to be printed on the sheet, and a control unit configured to perform, upon receipt of a printed sheet taking-out instruction, control to convey a sheet stored in the sheet storage unit so that at least a part of the sheet is exposed outside the printing apparatus, to print an image based on data saved in the saving unit, and to discharge the sheet on which the image has been printed outside the printing apparatus using the discharge unit.

Further features of the present disclosure will become apparent from the following description of exemplary embodiments with reference to the attached drawings.

BRIEF DESCRIPTION OF THE DRAWINGS

FIG. 8 is a conceptual diagram of a job management table according to the exemplary embodiment.

DESCRIPTION OF THE EMBODIMENTS

Exemplary embodiments will be described in detail below, with reference to the attached drawings. The following exemplary embodiments are not intended to be limiting, and any combination of features described in the exemplary embodiments is not necessarily essential to practice of the exemplary embodiments.

Figure 1:
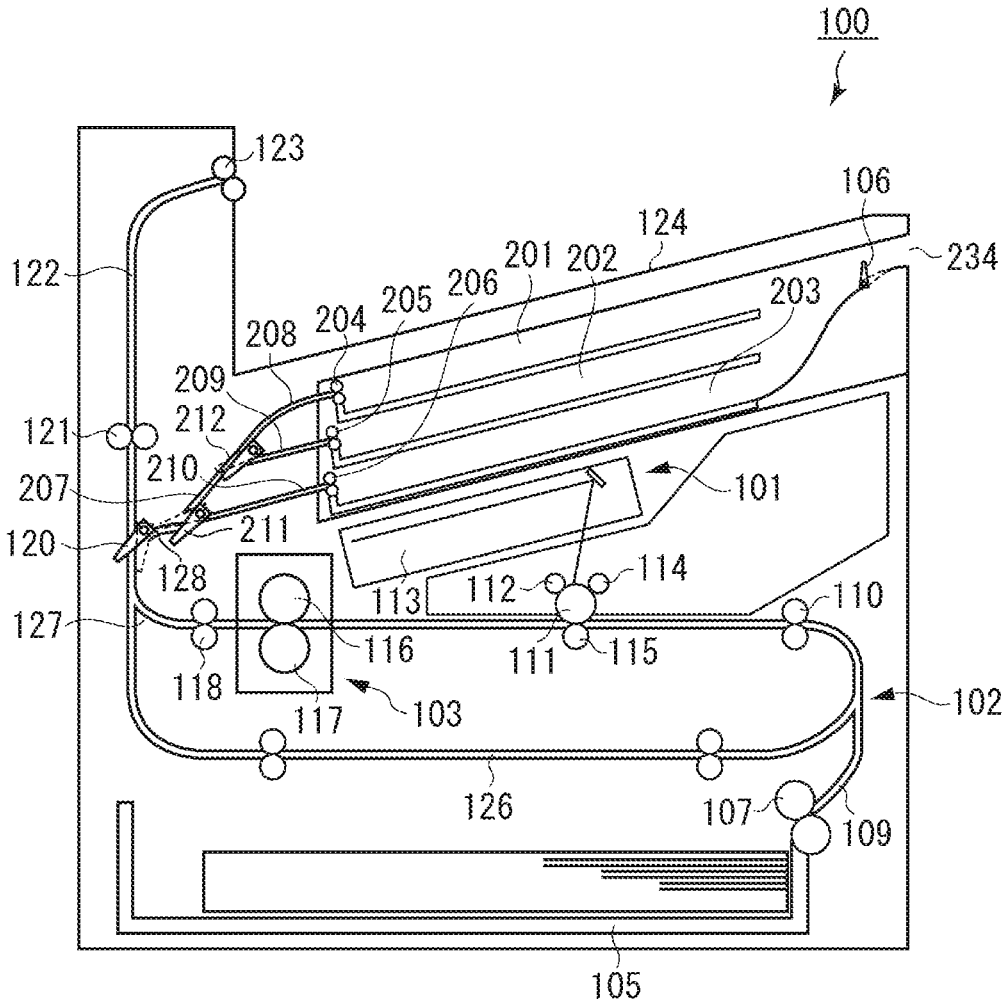
FIG. 1 is a cross-sectional diagram of a printing apparatus according to an exemplary embodiment.

Hereinafter, a first exemplary embodiment will be described. FIG. 1 illustrates a cross-sectional diagram of a printing apparatus 100, which is a monochrome digital printer provided as an example of a printing apparatus of the present exemplary embodiment. FIG. 1 illustrates the entire printing apparatus 100. The printing apparatus 100 includes a printing unit 101, a sheet feeding unit 102, and a fixing unit 103. The sheet feeding unit 102 feeds a sheet to the printing unit 101. The fixing unit 103 fixes an image on a sheet. The printing apparatus 100 further includes a stacking unit 124 provided on a top surface of the printing apparatus 100, that holds sheets (printed sheets) on which images are printed by the printing unit 101. A user can take a printed sheet discharged onto the stacking unit 124 without performing any operation, such as user authentication as described below.

The printing apparatus 100 further includes three sheet storage units (first, second, and third sheet storage units) 201, 202, and 203 to store sheets (printed sheets), on which images are printed by the printing unit 101, within the printing apparatus 100. The sheet storage units 201, 202, and 203 are disposed between the printing unit 101 and the stacking unit 124. In response to execution of an operation, such as user authentication as described below, a printed sheet stored in each of the sheet storage units 201, 202, and 203 is conveyed so that a part of the printed sheet is exposed outside of the printing apparatus 100. The user can then pull out the desired printed sheet. While the present exemplary embodiment refers to three sheet storage units, the number of sheet storage units may be any number other than three.

The printing unit 101 includes a photoconductive drum 111, a charging roller 112, an exposure device 113, a developing device 114, and a transfer roller 115. The photoconductive drum 111 rotates clockwise in FIG. 1. The charging roller 112, the developing device 114, and the transfer roller 115 are disposed in this order along a rotation direction of the photoconductive drum 111. Using these members, the printing unit 101 forms a toner image on a sheet.

The sheet feeding unit 102 includes a feeding cassette 105 configured to store stacked sheets used for printing. The sheet feeding unit 102 further includes a feeding roller 107, a conveying guide 109, a registration roller 110, and the like. The fixing unit 103 includes a fixing roller 116, a pressing roller 117 in contact with the fixing roller 116 from below, and a conveying roller 118. Between the printing unit 101, as well as the fixing unit 103 and the feeding cassette 105, a re-conveying path 126 is provided for a sheet used for printing an image on both sides (a front side and a back side) of the sheet.

A conveying roller 204 is provided to convey a sheet to the first sheet storage unit 201. Similarly, a conveying roller 205 is provided to convey a sheet to the second sheet storage unit 202, and a conveying roller 206 is provided to convey a sheet to the third sheet storage unit 203.

A conveying-path switching member 120 is configured to be switched between a first position indicated with a solid line in FIG. 1 and a second position indicated with a dashed line in FIG. 1. An actuator (not illustrated) enables the conveying-path switching member 120 to be switched between the first and second position. Further, reversing rollers 121 and 123 are provided that rotate both normally and reversely. The reversing rollers 121 and 123 discharge a sheet to the stacking unit 124 when rotated normally, and convey a sheet toward the re-conveying path 126 when rotated reversely.

The conveying-path switching member 120 is switched to the second position to convey a sheet toward the stacking unit 124. As a result, the sheet is conveyed along a discharge guide 122 by the reversing roller 121, and then discharged to the stacking unit 124 by the reversing roller 123.

The sheet including a toner image fixed on one side (a front side) is conveyed toward the reversing roller 123 to print an image on both sides of the sheet. Then, after a trailing end of the sheet passes through a branch section 127, the reversing roller 121 and the reversing roller 123 are rotated reversely. As a result, the sheet switchbacks and then passes through the re-conveying path 126, so that the sheet is conveyed again to the printing unit 101.

The conveying-path switching member 120 is switched to the first position so that the sheet is conveyed to the sheet storage units 201, 202, and 203 via a conveying path 128. A first switching member 211 and a second switching member 212 are each provided to switch paths for conveying a sheet. An actuator (not illustrated) enables each of the first switching member 211 and the second switching member 212 to be switched between a position indicated with a solid line (first position) and a position indicated with a dashed line (second position) in FIG. 1.

The first switching member 211 and the second switching member 212 are each switched to the first positions and maintained at the positions to convey a sheet to the first storage unit 201. The sheet on which an image is printed passes through the conveying path 128, a conveying guide 207, and a conveying guide 208, in this order. The sheet is further conveyed by the conveying roller 204, and then stored in the first sheet storage unit 201, in a face down state, i.e., a state where a side of the sheet on which the toner image is printed faces downward.

The first switching member 211 is switched to the first position and the second switching member 212 is switched to the second position and maintained at their respective positions to convey a sheet to the second sheet storage unit 202. The sheet on which an image is printed passes through the conveying path 128, the conveying guide 207, and a conveying guide 209, in this order. The sheet is further conveyed by the conveying roller 205, and then stored in the second sheet storage unit 202, in a face down state, i.e., a state where a side of the sheet on which the toner image is printed faces downward.

The first switching member 211 is switched to the second position and maintained at the position to convey a sheet to the third sheet storage unit 203. The sheet on which an image is printed passes through the conveying path 128 and a conveying guide 210, in this order. The sheet is further conveyed by the conveying roller 206, and then stored in the third sheet storage unit 203, in a face down state, i.e., a state where a side of the sheet on which the toner image is printed faces downward.

The sheet stored in each of the sheet storage units 201, 202, and 203 is conveyed to a discharge port 234 in response to a taking-out instruction from the user. This conveyance will be described in detail below with reference to FIG. 2 and FIGS. 3A and 3B. The sheet conveyed to the discharge port 234 is maintained in a state of being partially exposed outside of the printing apparatus 100, and waits to be removed by the user. A member 106 is provided to detect removal of the sheet from the discharge port 234. Before the sheet is conveyed to the discharge port 234 (and after the user removes the conveyed sheet), the member 106 is at a position (first position) indicated with a solid line in FIG. 1. The member 106 is at a position (second position) indicated with a dashed line in FIG. 1 when the sheet waits to be removed by the user after being conveyed to the discharge port 234. In the present exemplary embodiment, the discharge port 234 is provided as a single port common among the sheet storage units 201, 202, and 203. However, the sheet storage units 201, 202, and 203 may be respectively provided dedicated discharge ports.

Next, a detailed configuration of each of the sheet storage units 201, 202, and 203 will be described with reference to FIG. 2. The printing apparatus 100 includes the sheet storage units 201, 202, and 203 in a state where they are vertically stacked. The configurations of the sheet storage units 201, 202, and 203 are identical. Therefore, herein, only the configuration of the first sheet storage unit 201 will be described.

A sheet conveyed to the first sheet storage unit 201 by the conveying roller 204 is temporarily placed on a stack plane 231. Presence of a sheet on the stack plane 231 is detected via a sheet presence detector (not illustrated). A pushing-out member 233 is provided to push a conveying-direction upstream end part (a trailing-end part) of the stored sheet. As a result, a conveying-direction downstream end part (a leading-end part) of the sheet is exposed from the discharge port 234 to outside the printing apparatus 100. Since the pushing-out member 233 pushes out the sheet so that part of the sheet appears from the discharge port 234, the user removes the sheet. In the present exemplary embodiment, the length of the sheet exposed outside the printing apparatus 100 by the pushing-out member 233 is approximately 30 mm. However, this is just an exemplary amount, and any amount of the sheet that would enable the user to remove it while preventing the sheet from falling off due to self-weight would enable practice of the present exemplary embodiment.

For operational purposes of the printing apparatus 100, typically, the number and the size of sheets storable in the sheet storage units 201, 202, and 203 are limited. For example, the sheet storage units 201, 202, and 203 could each store only fifteen sheets of ordinary paper at a time. A full-state detecting lever 235 is provided to detect a full state of each of the sheet storage units 201, 202, and 203. When sheets thicker than ordinary paper are used, the number of storable sheets may be less. When each of the sheet storage units 201, 202, and 203 becomes full, a change occurs in inclination of the full-state detecting lever 235. A photo interrupter detects this change, and a signal indicating the detection result is input to a control unit 501 illustrated in FIG. 5 described below. Instead of providing the full-state detecting lever 235, the number of stored sheets may be counted up each time one sheet is stored, and storage (printing) may be restricted when the count reaches fifteen. In addition, an upper limit to the number of storable sheets may be other than fifteen.

The sheet storage units 201, 202, and 203 of the printing apparatus 100 can each store sheets of A4 size or smaller. Sheets of a size (such as B4 and A3) larger than A4 can be stacked on the stacking unit 124, but are not stored in the sheet storage units 201, 202, and 203 of the printing apparatus 100. In another exemplary embodiment, sheets larger than A4 can be stored in the sheet storage units 201, 202, 203.

Figure 2:
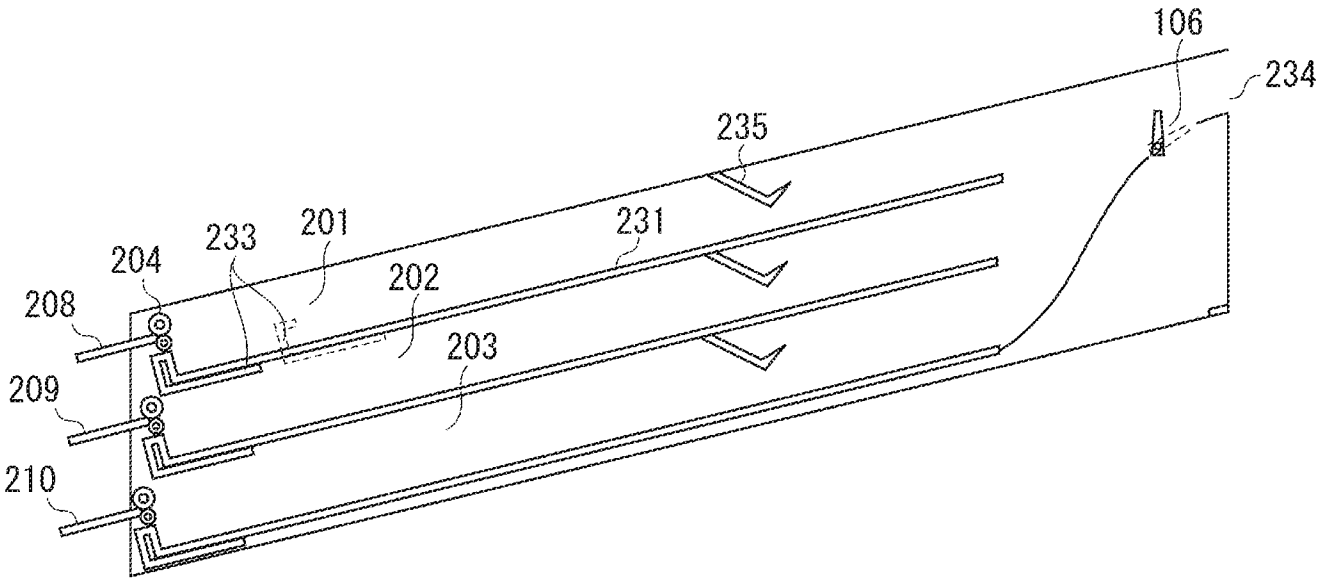
FIG. 2 is a cross-sectional diagram of a sheet storage unit according to the exemplary embodiment.

When a sheet is stored in the first sheet storage unit 201, the pushing-out member 233 is located at a stack position indicated with a solid line in FIG. 2, not to disturb conveyance and stacking of the sheet. When a stored sheet is pushed out, the pushing-out member 233 moves toward the discharge port 234 in a sheet discharge direction, until the pushing-out member 233 arrives at a pushing-out position (a sheet discharge position) indicated with a dashed line. Thereafter, the pushing-out member 233 returns to the stack position when the member 106 detects removal of the sheet by the user.

Figure 3A:
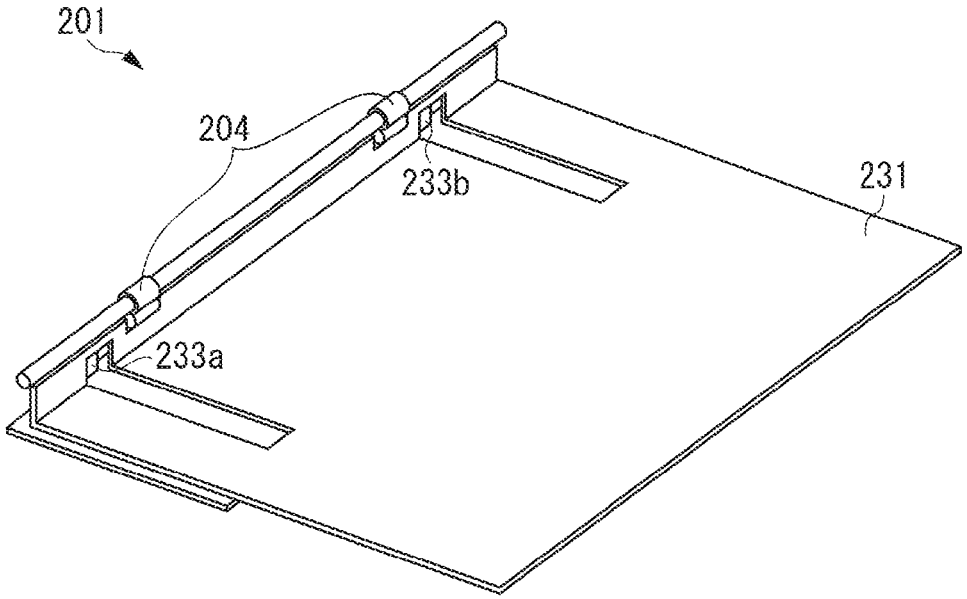
FIGS. 3A and 3B are perspective diagrams of the sheet storage unit according to the exemplary embodiment.
Figure 3B:
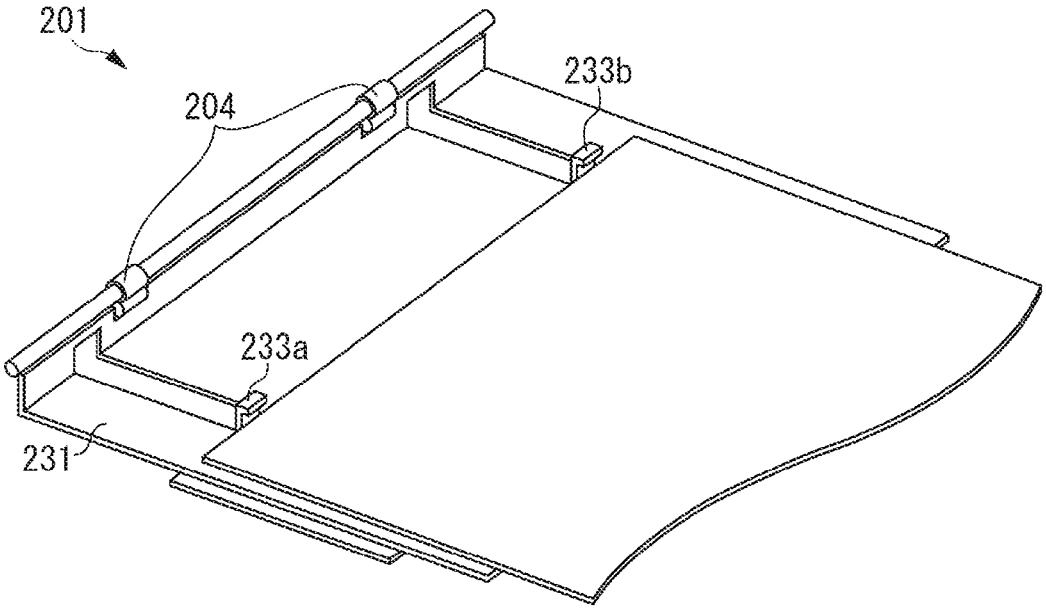

FIGS. 3A and 3B are perspective diagrams of the first sheet storage unit 201. FIG. 3A illustrates a state where the pushing-out member 233 is at the stack position. FIG. 3B illustrates a state where the pushing-out member 233 is at the pushing-out position. The pushing-out member 233 includes two sheet-trailing-end pressing nails 233*a* and 233*b* arranged in a sheet width direction to prevent a sheet from curling due to discharge of the sheet. When the sheet is pushed out, the sheet-trailing-end pressing nails 233*a* and 233*b* press the upstream end part of the sheet to discharge the sheet. The pushing-out member 233 moves back and forth, in the sheet discharge direction, between the stack position and the pushing-out position.

Figure 4:
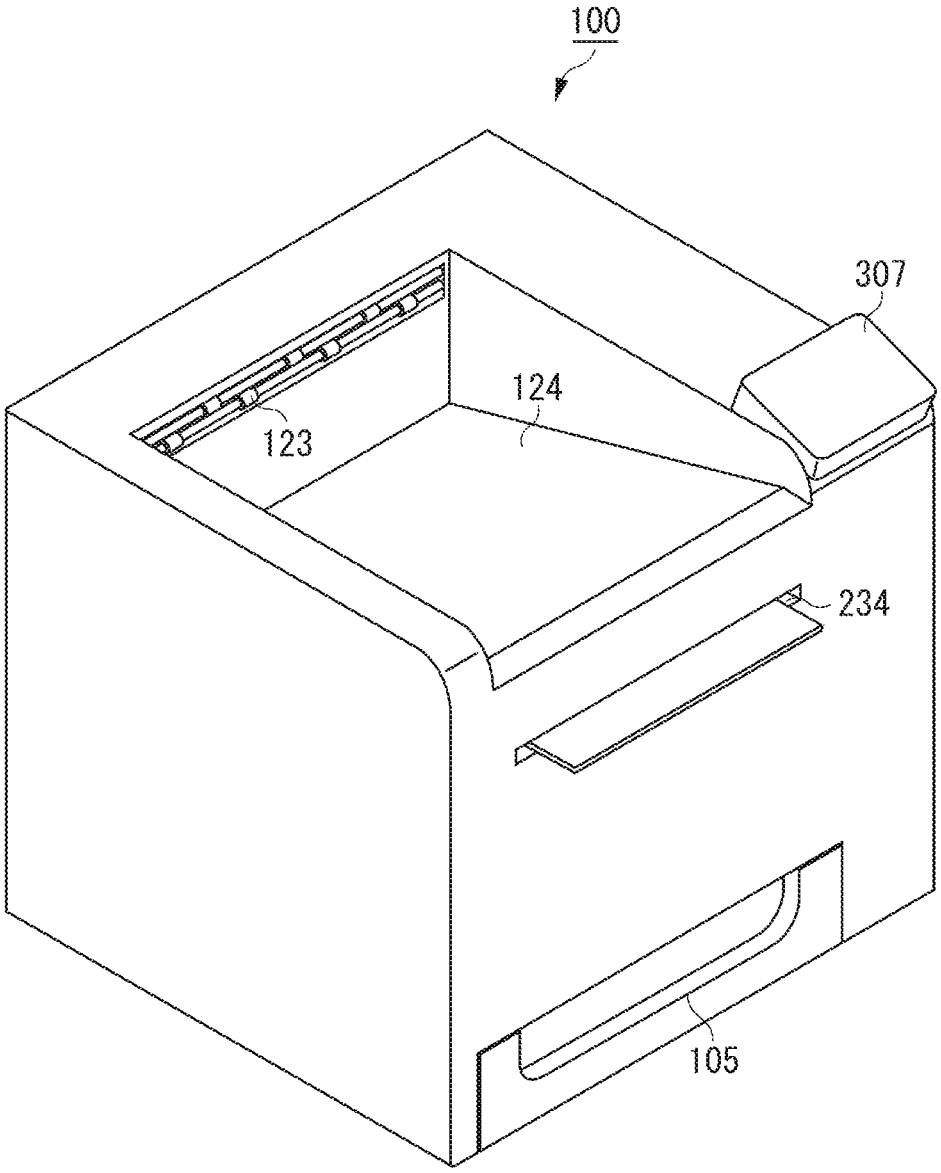
FIG. 4 is an external perspective diagram of the printing apparatus according to the exemplary embodiment.

FIG. 4 illustrates an external perspective diagram of the printing apparatus 100. A downstream end of a sheet bundle discharged from any one of the sheet storage units 201, 202, and 203 is exposed from the discharge port 234. The user can retrieve the user's printed sheets by holding the downstream end exposed outside the printing apparatus 100 and pulling out the sheet bundle. An operation display unit 307 is provided to receive instructions from the user to the printing apparatus 100, and to notify the user of various kinds of information.

Figure 5:
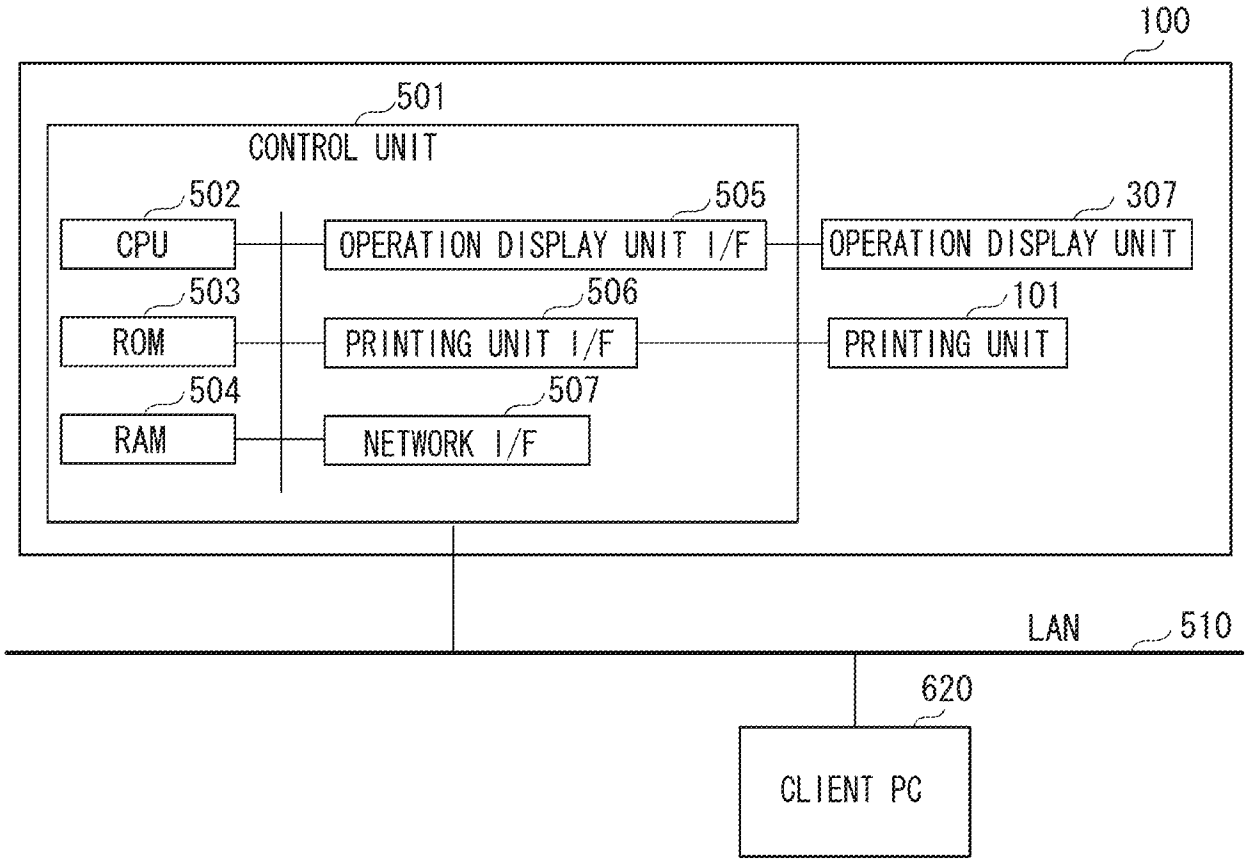
FIG. 5 is a hardware block diagram of a printing system according to the exemplary embodiment.

FIG. 5 is a block diagram illustrating a hardware configuration of the printing apparatus 100. The control unit 501 includes a central processing unit (CPU) 502 and controls operations of the entire printing apparatus 100. The CPU 502 reads a control program stored in a read only memory (ROM) 503, to control a print operation and sheet conveyance. A random access memory (RAM) 504 is used as a temporary storage area serving as a main memory or a work area for the CPU 502. In the printing apparatus 100, the CPU 502 executes each process in each flowchart described below by using one memory (the RAM 504), but other configuration types may be adopted. For example, each process may be executed by causing one or more CPUs and one or more RAMs to work together.

An operation display unit interface (I/F) 505 connects the operation display unit 307 to the control unit 501. The operation display unit 307 serves as a receiving unit for receiving a taking-out instruction as described below for taking out/removing a printed sheet. The operation display unit 307 also serves as a card reader for reading a user identification (ID) from, for example, an integrated circuit (IC) card. The user ID is used for user authentication as described below. The operation display unit 307 further serves as a display unit that displays a screen for providing notifications to the user, as will be described below.

A printing unit I/F 506 connects the printing unit 101 to the control unit 501. An image to be printed by the printing unit 101 is transferred from the control unit 501 to the printing unit 101 via the printing unit I/F 506, and then printed on a sheet by the printing unit 101.

A network I/F 507 connects the printing apparatus 100 to a local area network (LAN) 510. A client personal computer (PC) 620 is connected to the LAN 510. The network I/F 507 receives a print job generated by a printer driver installed on the client PC 620.

Figure 6:
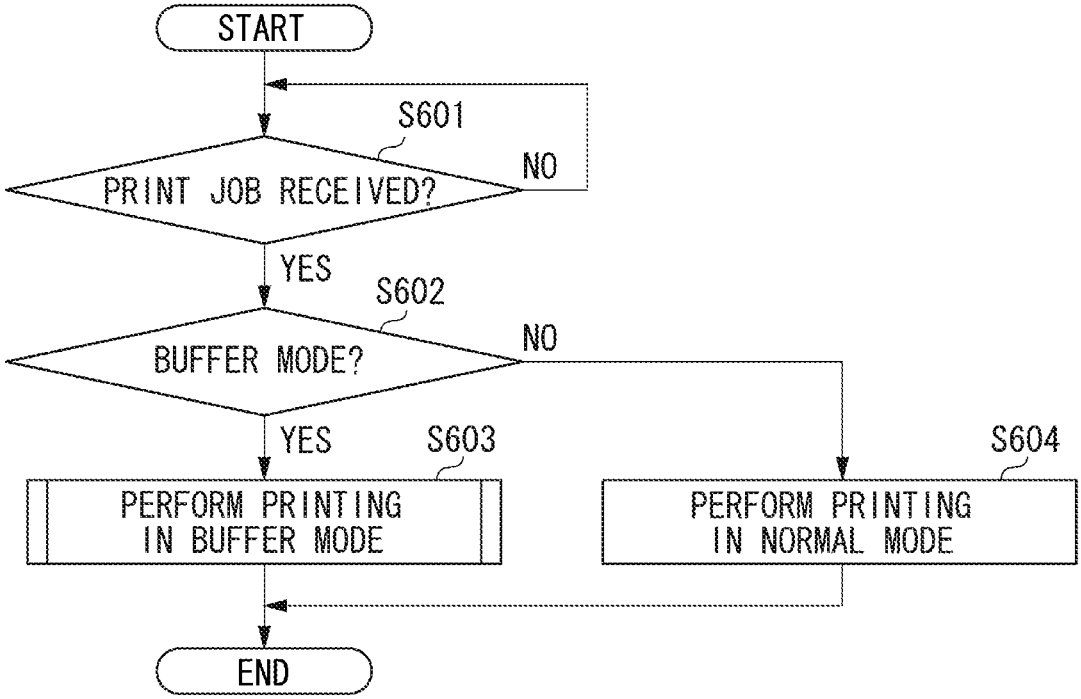
FIG. 6 is a flowchart illustrating an operation of the printing apparatus according to the exemplary embodiment.
Figure 7:
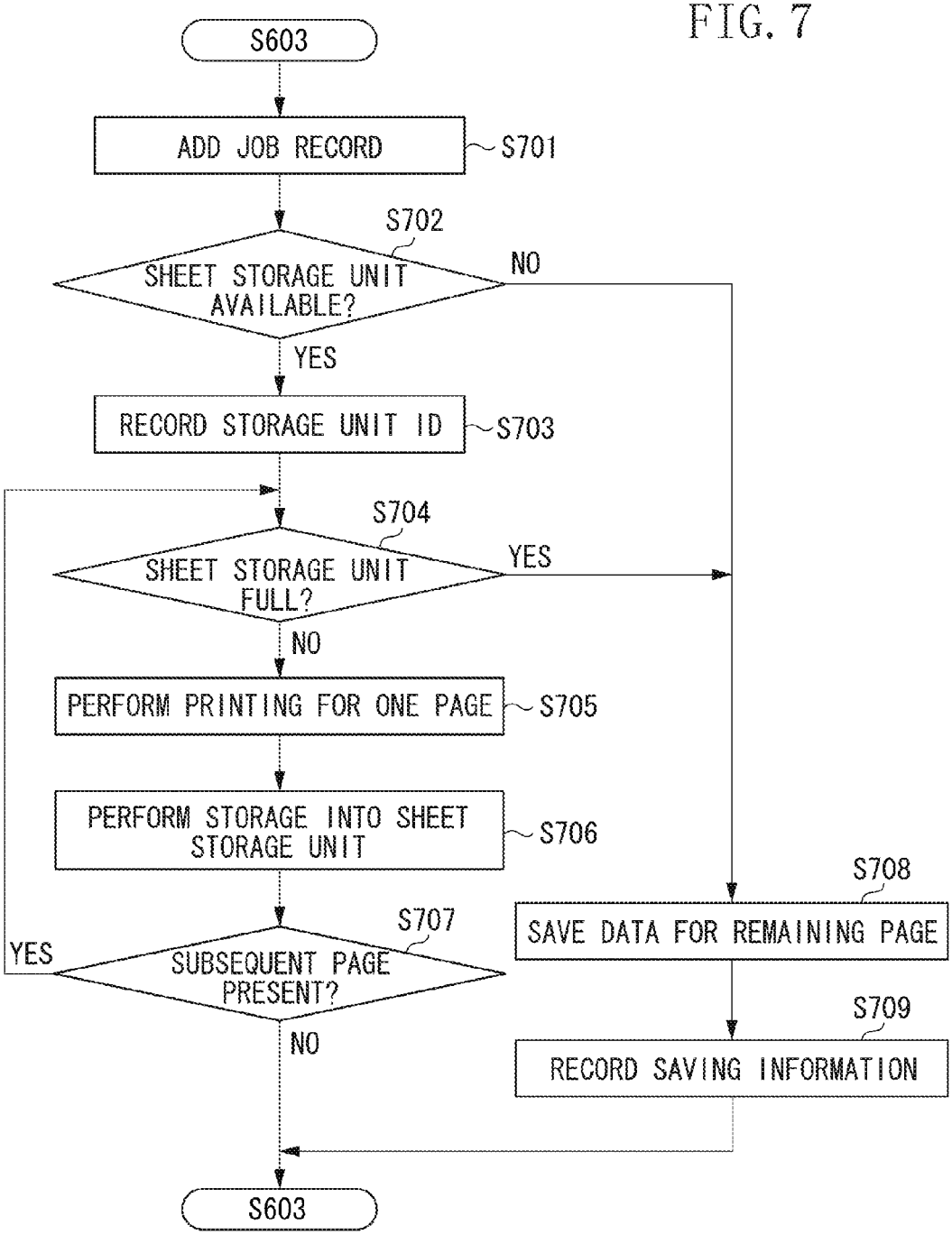
FIG. 7 a flowchart illustrating an operation of the printing apparatus according to the exemplary embodiment.

FIGS. 6 and 7 are flowcharts illustrating an operation of printing an image on a sheet by the printing apparatus 100, based on a print job received from the client PC 620. Each operation (step) in the flowchart of each of FIGS. 6 and 7 is implemented by the control unit 501 (CPU 502) of the printing apparatus 100, executing the control program stored in the ROM 503.

In step S601 of FIG. 6, it is determined whether a print job is received. When it is determined that a print job is received (YES in step S601), the processing proceeds to step S602. On the other hand, when it is determined that a print job has not been received (NO in step S601), the processing waits until a print job is received.

In step S602, it is determined whether a buffer mode is designated in the received print job. The printing apparatus 100 has two modes, i.e., a normal mode and the buffer mode. Which mode is to be used for printing can be designated with the printer driver. Further, a mode other than the normal mode and the buffer mode may be provided.

In the buffer mode, a printed sheet is temporarily stored in any one of the sheet storage units 201, 202, and 203, and then is exposed to enable a user to remove the printed sheet from the discharge port 234 in response to an instruction of the user. When the buffer mode is designated, the printed sheet can be prevented from being seen by other people during a period from when a printing instruction is issued via the client PC 620 by the user until the user arrives at the printing apparatus 100. In addition, since the printing starts before the user arrives at the printing apparatus 100, the wait time for the user to retrieve the printed sheet is shorter than a configuration in which printing starts after a user arrives at the printing apparatus 100.

When it is determined that the buffer mode is designated (YES in step S602), the processing proceeds to step S603

(FIG. 7). When it is determined that the buffer mode is not designated (NO in step S602, i.e., when the normal mode is designated), the processing proceeds to step S604. In step S604, an image is printed on a sheet based on the received print job, and the printed sheet is discharged to the stacking unit 124 via members such as the discharge guide 122. The printed sheet discharged to the stacking unit 124 can be removed without user authentication.

In step S701 of FIG. 7, a new job record is added to a job management table 800 stored in the ROM 503. FIG. 8 is a conceptual diagram of the job management table 800. In the job management table 800, print jobs are managed using one record for one print job. In the job management table 800, a job ID, a user ID, a reception date and time, a storage unit ID, and saving information are recorded in this order from the left for each print job. The job ID is information assigned by the printing apparatus 100 to each print job in which the buffer mode is designated in the reception order of the print jobs. If there is a job ID assigned by the client PC 620, this job ID may be used instead. The user ID is information indicating a user who is the owner of a received print job. The print job received from the client PC 620 is presumed to include the user ID.

The reception date and time is information indicating the date and time when a print job is received by the printing apparatus 100. The storage unit ID is information indicating a sheet storage unit as a storage destination when a printed sheet resulting from execution of a print job is stored in a sheet storage unit. Herein, numbers 201, 202, and 203 of the respective sheet storage units 201, 202, and 203 in FIG. 2 are each used as the storage unit ID. However, this is merely described as an example, and the storage unit ID may be other types of information as long as each of the sheet storage units 201, 202, and 203 can be identified. As the storage unit ID, "–" is recorded as a default value. When a printed sheet is stored in any one of the sheet storage units 201, 202, and 203, the storage unit ID is updated to a storage unit ID corresponding to a sheet storage unit serving as a storage destination.

The saving information indicates whether there is data that is saved in the RAM 504 without being printed because of a situation where a printed sheet cannot be stored in any of the sheet storage units 201, 202, and 203 although the buffer mode is designated in a print job. Examples of the situation where a printed sheet cannot be stored in any of the sheet storage units 201, 202, and 203, include a case where no sheet storage unit is available, a case where the number of printed sheets exceeds the number of storable sheets, and a case where the size of a sheet used for printing is larger than the size of storable sheets. As the saving information, "–" is recorded as a default value. The saving information is updated to "present" at the time of saving data for pages that cannot be stored in any of the sheet storage units 201, 202, and 203.

Referring back to FIG. 7, in step S702, it is determined whether there is an available sheet storage unit from among the sheet storage units 201, 202, and 203. When it is determined that there is an available sheet storage unit (YES in step S702), the processing proceeds to step S703. When it is determined that no sheet storage unit is available (NO in step S702), the processing proceeds to step S708. In step S703, the ID of the available sheet storage unit (the sheet storage unit to be used) is recorded in the job record added in step S701.

In step S704, whether the available sheet storage unit has become full is determined based on a result of detection by the full-state detecting lever 235. Immediately after the processing proceeds to step S704 from step S703, the sheet storage unit cannot be full. However, the sheet storage unit may become full, if steps S705 to step S707 described below are performed repeatedly to print an image for more than one page. When it is determined that the sheet storage unit has not become full (NO in step S704), the processing proceeds to step S705. On the other hand, when it is determined that the sheet storage unit has become full (YES in step S704), the processing proceeds to step S708.

In step S705, the printing unit 101 is controlled to print an image for one page on one sheet. Herein, the image for the one page is laid out on an entire plane of the one sheet, assuming that single-sided printing is performed. However, when N-on-1 printing or double-sided printing is performed, printing for the one sheet is completed in step S705.

In step S706, a printed sheet resulting from the printing in step S705 is stored in the sheet storage unit, via members such as the conveying path 128. In step S707, whether there is a subsequent page (a page for which printing is yet to be completed) is determined. When it is determined that there is a subsequent page (YES in step S707), the processing returns to step S704. On the other hand, when it is determined that there is no subsequent page (NO in step S707), the processing ends.

In step S708, data for pages that cannot be stored in the sheet storage unit (not printed) is saved in the RAM 504. When it is determined that there is no available sheet storage unit in step S702 (NO in step S702), data for all pages is saved in the RAM 504. In step S709, "present" is recorded as the saving information, in the job record added in step S701.

Through the above-described operation, among pages included in a print job for which the buffer mode is designated, a page corresponding to a printed sheet storable in the sheet storage unit is printed upon receipt of the print job. On the other hand, a page corresponding to a printed sheet that cannot be stored in the sheet storage unit is not printed and data thereof is stored. As for a print job for which the normal mode is designated, printing is performed upon receipt of the print job, and then a sheet is discharged to the stacking unit 124.

Figure 9:
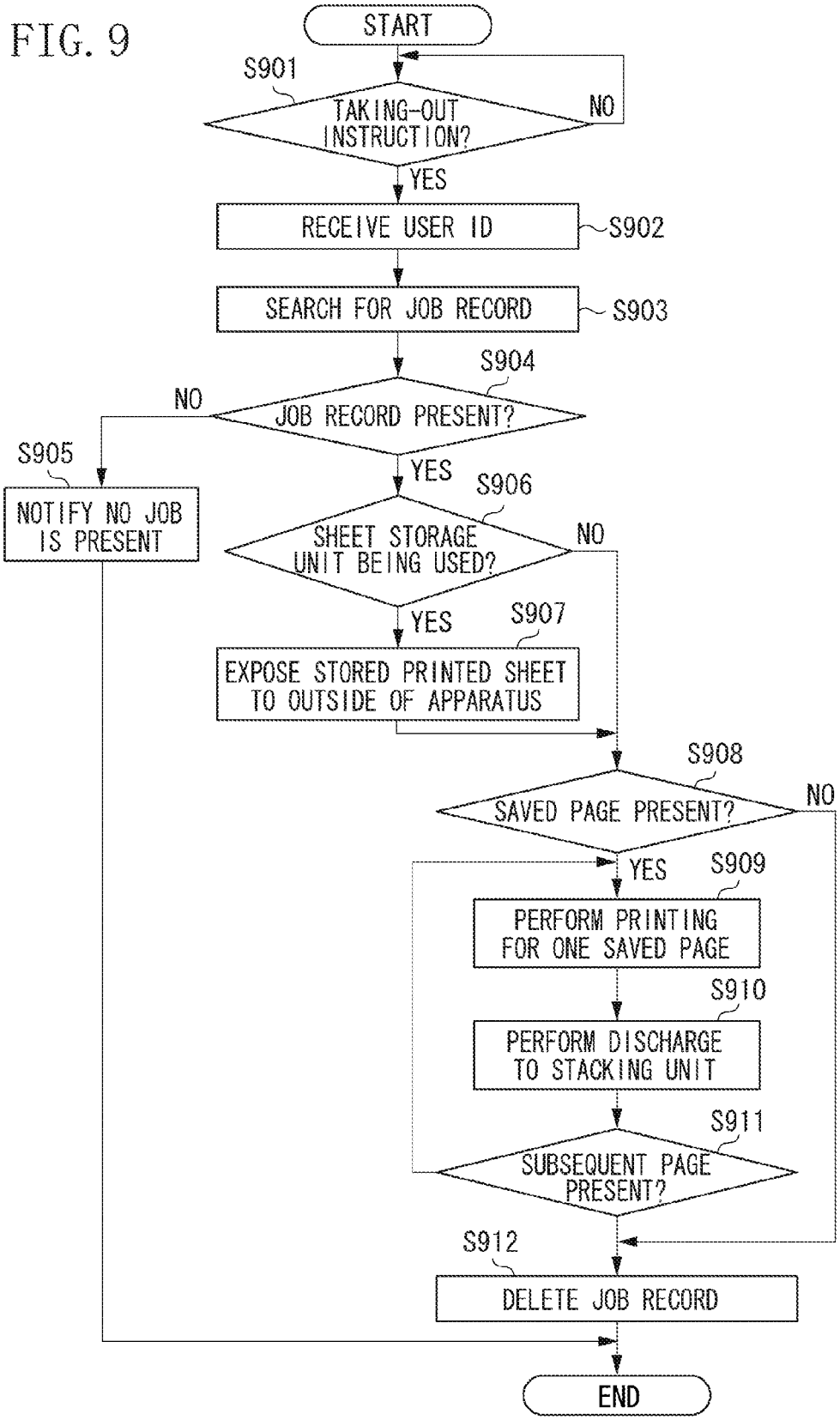
FIG. 9 is a flowchart illustrating an operation of the printing apparatus according to the exemplary embodiment.

FIG. 9 is a flowchart illustrating an operation performed in the printing apparatus 100, when a user takes out a printed sheet based on a print job for which the buffer mode is designated. Each operation (step) in the flowchart of FIG. 9 is implemented by the control unit 501 of the printing apparatus 100, executing the control program stored in the ROM 503.

In step S901, whether a taking-out instruction is received from the user via the operation display unit 307 is determined. When it is determined that a taking-out instruction is received (YES in step S901), the processing proceeds to step S902. On the other hand, when it is determined that no taking-out instruction is received (NO in step S901), the processing waits until a taking-out instruction is received. In step S902, an input of a user ID from the user is received. When an IC card is used, the user ID is input by the operation display unit 307 reading the IC card. It may be determined that a taking-out instruction for a printed sheet is received when the IC card is held over the operation display unit 307. In addition to the user ID, a password may be received. When the IC card is used, the user is identified based on possession of the IC card. However, when the user directly inputs the user ID via a numeric keypad, security can be enhanced by prompting the user to input the password.

In step S903, the job management table 800 is searched for a job record corresponding to the user ID received in step S902. In step S904, whether the job record corresponding to the user ID is found as a result of the search in step S903 is determined. When it is determined that the job record is found (YES in step S904), the processing proceeds to step S906. On the other hand, when it is determined that no job record is found (NO in step S904), the processing proceeds to step S905. In step S905, a screen for notifying the user that no corresponding job is present is displayed on the operation display unit 307.

In step S906, whether there is a sheet storage unit used by a print job of the found job record is determined. More specifically, it is determined that there is a sheet storage unit being used, if a storage unit ID is recorded in the job record. On the other hand, it is determined that no sheet storage unit is used, if no storage unit ID is recorded in the job record. When it is determined that there is a sheet storage unit being used (YES in step S906), the processing proceeds to step S907. On the other hand, when it is determined that no sheet storage unit is used (NO in step S906), the processing proceeds to step S908.

In step S907, the printed sheet stored in the sheet storage unit is conveyed using the pushing-out member 233, and then exposed from the discharge port 234 to the outside of the printing apparatus 100. The user can receive the printed sheet by holding an exposed part and pulling out the printed sheet.

In step S908, whether a page saved without being printed is present in the print job of the found job record is determined. More specifically, it is determined that there is a saved page if "present" is recorded as the saving information in the job record, whereas it is determined that there is no saved page if "present" is not recorded. When it is determined that there is a saved page (YES in step S908), the processing proceeds to step S909. When it is determined that there is no saved page (NO in step S908), the processing proceeds to step S912.

In step S909, an image for one page among the saved pages is printed on one sheet (for one sheet as in step S705). In step S910, a printed sheet resulting from the printing in step S909 is discharged to the stacking unit 124 via members such as the discharge guide 122. In step S911, whether there is a subsequent page (a page for which printing is yet to be completed) is determined. When it is determined that there is a subsequent page (YES in step S911), the processing returns to step S909. On the other hand, when it is determined that there is no subsequent page (NO in step S911), the processing proceeds to step S912.

In step S912, the job record of the job processed in steps S906 to S911 is deleted from the job management table 800. In addition, when more than one job record are found in step S904, the processing may return to step S906 to continue the subsequent print job.

Through the above-described operation, a printed sheet stored in the sheet storage unit is exposed on the outside of the printing apparatus 100 in response to a taking-out instruction. Therefore, the printed sheet is prevented from being stealthily seen by other people. In addition, also for a page that cannot be stored in the sheet storage unit, printing for producing a printed sheet is performed in response to a taking-out instruction. Therefore, similar to the printed sheet stored in the sheet storage unit, the printed sheet is prevented from being stealthily seen by other people. The determination in step S908 may be performed before the determination in step S906, and if there is a page that cannot be stored in the sheet storage unit, the user may be notified of the result before the printed sheet is exposed in step S907. This configuration can prevent the user from taking only the exposed printed sheet without knowing the presence of a page that cannot be stored in the sheet storage unit.

Figure 10:
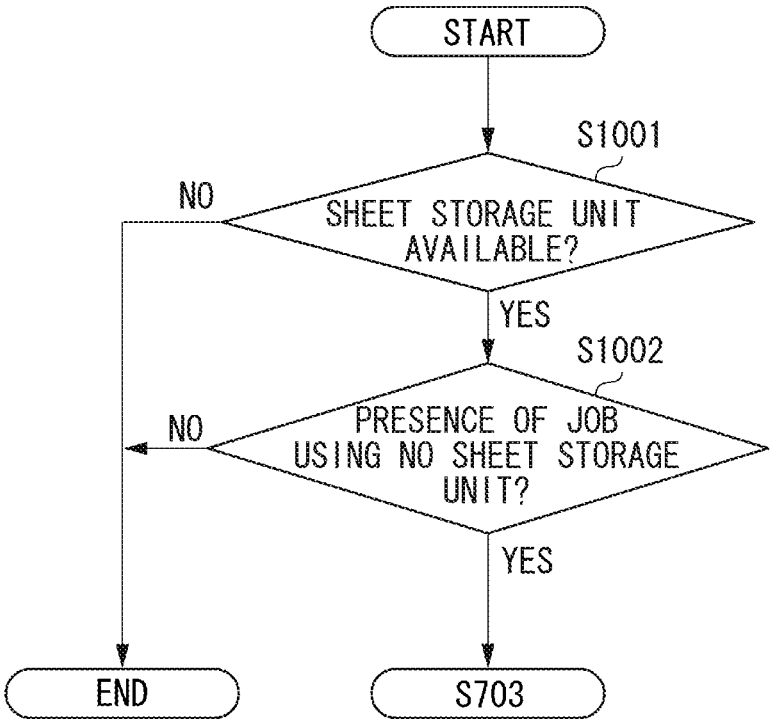
FIG. 10 is a flowchart illustrating an operation of the printing apparatus according to the exemplary embodiment.

FIG. 10 is a flowchart illustrating an operation performed by the printing apparatus 100, to execute printing based on data that is saved in the RAM 504 because of no sheet storage unit being available. This printing is executed in response to such an event that any of the sheet storage units 201, 202, and 203 becomes available. Each operation (step) in the flowchart of FIG. 10 is implemented by the control unit 501 of the printing apparatus 100, executing the control program stored in the ROM 503. The operation in the flowchart of FIG. 10 is assumed to be periodically executed while the printing apparatus 100 is turned on, but may be executed in a different way. For example, the operation in the flowchart of FIG. 10 may be executed in response to such an event that removal of the printed sheet exposed from the discharge port 234 is detected by the member 106, after the process in step S906 is executed. In this case, the determination in step S1001 can be omitted.

In step S1001, whether there is an available sheet storage unit among the sheet storage units 201, 202, and 203, is determined based on a result of detection by the sheet presence detector (not illustrated). When it is determined that there is an available sheet storage unit (YES in step S1001), the processing proceeds to step S1002. On the other hand, when it is determined that no sheet storage unit is available (NO in step S1001), the processing ends.

In step S1002, whether there is a print job using no sheet storage unit is determined. More specifically, if there is a print job with no storage unit ID recorded in a job record, it is determined that there is a print job using no sheet storage unit. When it is determined that there is a print job using no sheet storage unit (YES in step S1002), the processing proceeds to step S703 of FIG. 7. In step S703, printing is performed based on the print job, and a sheet on which an image is printed is stored in the available sheet storage unit. On the other hand, when it is determined that there is not a print job using no sheet storage unit (NO in step S1002), the processing ends.

Next, a second exemplary embodiment will be described. In the first exemplary embodiment, the case where the sheet cannot be stored in the sheet storage unit is presumed to be either when no sheet storage unit is available or when the available sheet storage unit is full. In the second exemplary embodiment a case where the size of a sheet to be used for printing is not the size of sheets storable in the sheet storage units is considered. Only functions, feature, etc. that differ from the first exemplary embodiment will be described below.

Figure 11:
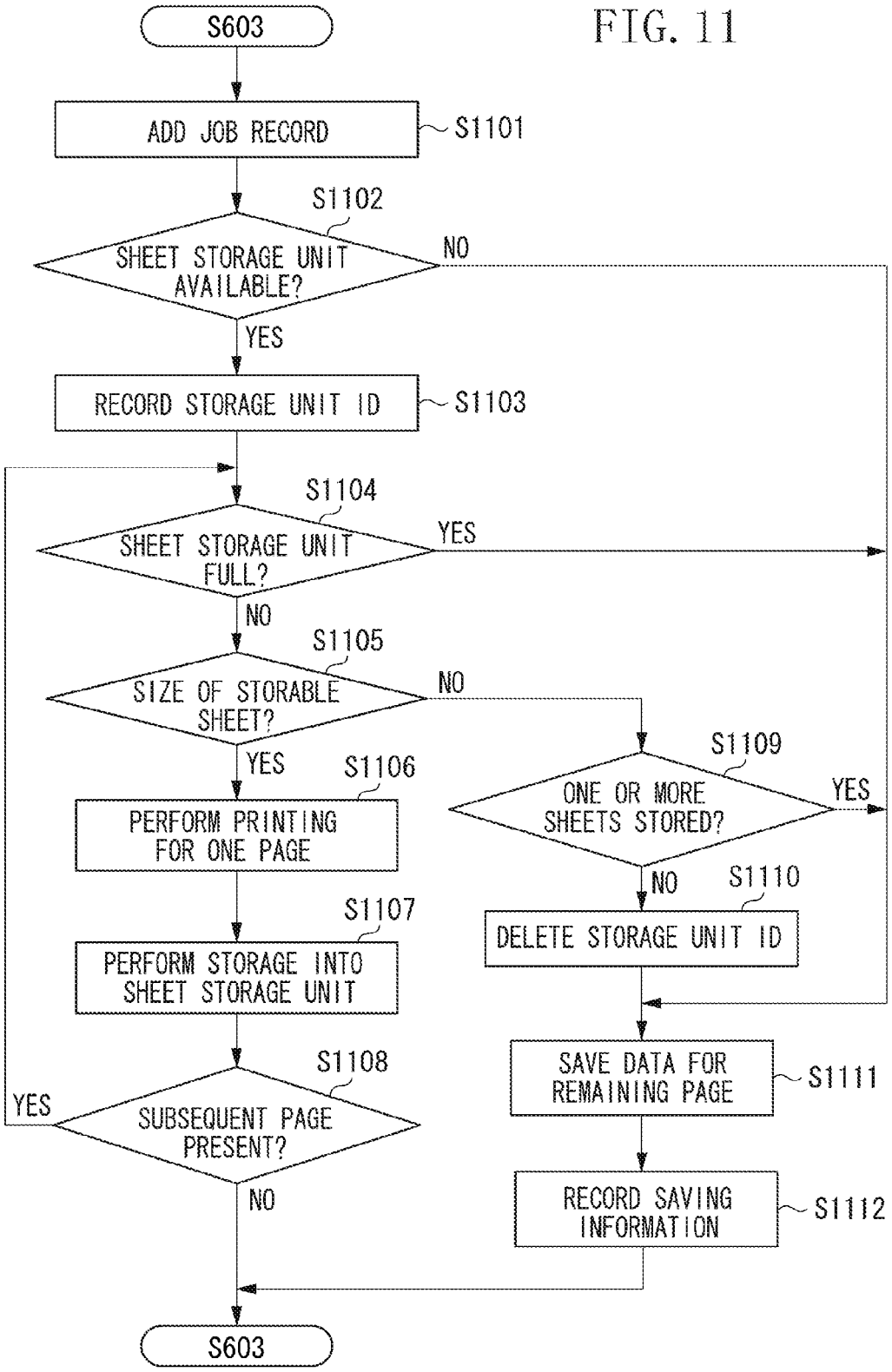
FIG. 11 is a flowchart illustrating an operation of a printing apparatus according to another exemplary embodiment.

FIG. 11 illustrates a flowchart corresponding to the flowchart of FIG. 7 in the first exemplary embodiment. The flowchart of FIG. 11 illustrates an operation of printing an image on a sheet in a printing apparatus 100, based on a print job received from a client PC 620. Each operation (step) in the flowchart of FIG. 11 is implemented by a control unit 501 of the printing apparatus 100, executing a control program stored in a ROM 503.

In step S1101 of FIG. 11, a new job record is added to a job management table stored in the ROM 503. In step S1102, a determination is made whether there is an available sheet storage unit from among sheet storage units 201, 202, and 203. When it is determined that there is an available sheet storage unit (YES in step S1101), the processing proceeds to step S1103. On the other hand, when it is determined that no sheet storage unit is available (NO in step S1101), the processing proceeds to step S1111. In step S1103, an ID of the available sheet storage unit (the sheet storage unit to be used) is recorded in the job record added in step S1101.

In step S1104, a determination is made, based on a result detection by a full-state detecting lever 235, whether the available sheet storage unit is full. Immediately after the processing proceeds to step S1104 from step S1103, the sheet storage unit cannot be full. However, the sheet storage unit may become full if steps S1106 to S1108 described below, are performed repeatedly. When it is determined that the sheet storage unit is not full (NO in step S1104), the processing proceeds to step S1105. On the other hand, when it is determined that the sheet storage unit is full (YES in step S1104), the processing proceeds to step S1111.

In step S1105, it is determined whether the size of a sheet corresponding to a page to be printed next is the size of sheets storable in the sheet storage units 201, 202, and 203. Herein, it is determined that the sheet can be stored in the sheet storage units 201, 202, and 203 if the size is A4 or smaller, whereas it is determined that the sheet cannot be stored in the sheet storage units 201, 202, and 203 if the size exceeds A4. When it is determined that the size is the size of sheets storable in the sheet storage units 201, 202, and 203 (YES in step S1105), the processing proceeds to step S1106. On the other hand, when it is determined that the size is not the size of storable sheets (NO in step S1105), the processing proceeds to step S1109. While the present exemplary embodiment describes A4 as the determining sheet size, any sheet size that would enable practice of the present invention can be used.

In step S1106, a printing unit 101 is controlled to print an image for one page on one sheet. Herein, the image for the one page is laid out on an entire plane of the one sheet, presuming that single-sided printing is performed. However, when N-on-1 printing or double-sided printing is performed, printing for the one sheet is completed in step S1106.

In step S1107, a printed sheet resulting from the printing in step S1106 is stored in the sheet storage unit, via members such as the conveying path 128. In step S1108, it is determined whether a subsequent page exists (a page for which printing is yet to be completed). When it is determined that there is a subsequent page (YES in step S1108), the processing returns to step S1104. On the other hand, when it is determined that there is no subsequent page (NO in step S1108), the processing ends.

In step S1109, it is determined whether one or more sheets are stored in the sheet storage unit. When it is determined that one or more sheets are stored in the sheet storage unit (YES in step S1109), the processing proceeds to step S1111. On the other hand, when it is determined that there are not one or more sheets stored (NO in step S1109), the processing proceeds to step S1110. In step S1110, the storage unit ID recorded in the job record in step S1103 is deleted, and a default value of "–" is restored. This processing is performed based on a presumption that the size of a sheet to be used for printing a first page of the received print job is not the size of sheets storable in the sheet storage units and no sheet is to be stored in the sheet storage unit.

In step S1111, data for a page that cannot be stored in the sheet storage unit (not printed) is saved in the RAM 504. In step S1112, "present" is recorded as the saving information, in the job record added in step S1101.

As described above, in addition to the operation of the first exemplary embodiment, in a case of including a page to be printed using a sheet of a size not storable in the sheet storage units, the data of the page is saved, and this page is printed in response to a taking-out instruction included in a printing instruction. Therefore, security can be ensured, even if a page, which is to be printed using a sheet of a size not storable in the sheet storage units, is included. If the operation described with reference to FIG. 10 is performed in the second exemplary embodiment, the processing proceeds to step S1103 when it is determined that there is a print job using no sheet storage unit (YES in step S1002).

The present exemplary embodiment is applicable to any cases where a sheet cannot be stored in the sheet storage unit, other than the above mentioned cases which are the case where no sheet storage unit is available, the case where the available sheet storage unit becomes full, and the case where the size of a sheet to be used for printing is not the size of sheets storable in the sheet storage units.

Further, when a sheet stored in the sheet storage unit is discharged outside of the printing apparatus, the sheet may be conveyed until the entire sheet is discharged outside of the printing apparatus, instead of the configuration in which the sheet is exposed only partially to wait until the sheet is removed by a user as described above.

Aspects of the above-described exemplary embodiments are also achieved by executing the following processing. Specifically, a system or apparatus is supplied with a storage medium that stores a program code of software for implementing the functions of the exemplary embodiments described above. Then, the system or computer (alternatively, a CPU, a micro processing unit (MPU), or the like) reads the program code stored in the storage medium.

In this case, the program code read from the storage medium implements the functions of the exemplary embodiments. Therefore, the program code and the storage medium storing the program code are used to configure each of the exemplary embodiments.

According to the exemplary embodiments, it is possible to utilize suitably the sheet storage unit provided inside the printing apparatus, while appropriately protecting confidential information.

Other Embodiments

Additional embodiments can also be realized by a computer of a system or apparatus that reads out and executes computer executable instructions recorded on a storage medium (e.g., non-transitory computer-readable storage medium) to perform the functions of one or more of the above-described embodiment(s), and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that these exemplary embodiments are not seen to be limiting. The scope of the following claims is to be accorded the broadest interpretation so as to encompass all such modifications and equivalent structures and functions.

This application claims the benefit of Japanese Patent Application No. 2014-119016, filed Jun. 9, 2014, which is hereby incorporated by reference herein in its entirety.

What is claimed is:

1. A printing apparatus comprising;

a printing unit configured to print, on a sheet, an image for one page or a plurality of pages;

a sheet storage unit configured to store, inside the printing apparatus, a sheet on which an image has been printed;

a discharge unit configured to discharge, outside the printing apparatus, a sheet on which an image has been printed without storing the sheet in the sheet storage unit;

a saving unit configured to save, in a case where a sheet is not storable in the sheet storage unit, data corresponding to a page to be printed on the sheet; and a control unit configured to perform, upon receipt of a printed sheet taking-out instruction, control to convey a sheet stored in the sheet storage unit so that at least a part of the sheet is exposed outside the printing apparatus, to print an image based on data saved in the saving unit, and to discharge, outside the printing apparatus using the discharge unit, the sheet on which the image has been printed.

2. The printing apparatus according to claim 1, further comprising an identification unit configured to identify a user, wherein the control unit performs control to convey, from among sheets stored in the sheet storage unit, a sheet corresponding to the user identified by the identification unit, and to print, from among data saved in the saving unit, data corresponding to the user identified by the identification unit.

3. The printing apparatus according to claim 1, further comprising a notifying unit configured to notify, before a sheet stored in the sheet storage unit is conveyed to be partially exposed outside the printing apparatus, a user that a sheet is to be discharged by the discharge unit.

4. The printing apparatus according to claim 1, further comprising a holding unit configured to hold a sheet stored in the sheet storage unit in a state where only a part of the sheet is exposed outside of the printing apparatus, wherein, upon receipt of a printed sheet taking-out instruction, the control unit performs control to convey the sheet stored in the sheet storage unit to a position where the sheet is held by the holding unit.

5. The printing apparatus according to claim 1, further comprising one or more sheet storage units, wherein the case where the sheet is not storable in the sheet storage unit includes a case where no sheet storage unit is available.

6. The printing apparatus according to claim 5, wherein, in response to any of the one or more sheet storage units becoming available, the control unit performs control to print an image based on data saved in the saving unit, and to store, in the available sheet storage unit, a sheet on which the image has been printed.

7. The printing apparatus according to claim 1, wherein the case where the sheet is not storable in the sheet storage unit includes a case where the sheet storage unit becomes full during printing of an image for a plurality of pages.

8. The printing apparatus according to claim 1, wherein the case where the sheet is not storable in the sheet storage unit includes a case where a size of a sheet to be used for printing is not a size of a sheet storable in the sheet storage unit.

9. A method for a printing apparatus, the method comprising;

printing, on a sheet, an image for one page or a plurality of pages;

storing, inside the printing apparatus, a sheet on which an image has been printed;

discharging, outside the printing apparatus, a sheet on which an image has been printed without storing the sheet;

saving, in a case where a sheet is not storable, data corresponding to a page to be printed on the sheet; and performing, upon receipt of a printed sheet taking-out instruction, control to convey a stored sheet so that at least a part of the sheet is exposed outside the printing apparatus, to print an image based on saved data, and to discharge, outside the printing apparatus, the sheet on which the image has been printed.

10. The method according to claim 9, further comprising identifying a user, wherein performing control includes performing control to convey, from among stored sheets, a sheet corresponding to the identified user, and to print, from among saved data, data corresponding to the identified user.

11. The method according to claim 9, further comprising notifying, before a stored sheet is conveyed to be partially exposed outside the printing apparatus, a user that a sheet is to be discharged.

12. The method according to claim 9, further comprising holding a stored sheet in a state where only a part of the sheet is exposed outside of the printing apparatus, wherein, upon receipt of a printed sheet taking-out instruction, performing control includes performing control to convey the stored sheet stored to a position where the sheet is held.

13. The method according to claim 9, wherein the case where the sheet is not storable includes a case where no sheet storage unit among one or more sheet storage units of the printing apparatus is available.

14. The method according to claim 13, wherein, in response to any of the one or more sheet storage units becoming available, performing control includes performing control to print an image based on saved data, and to store, in the available sheet storage unit, a sheet on which the image has been printed.

15. The method according to claim 9, wherein the case where the sheet is not storable includes a case where a sheet storage unit of the printing apparatus becomes full during printing of an image for a plurality of pages.

16. The method according to claim 9, wherein the case where the sheet is not storable includes a case where a size of a sheet to be used for printing is not a size of a sheet storable in a sheet storage unit of the printing apparatus.

17. A non-transitory computer-readable storage medium storing computer executable instructions that causes a computer to perform a printing method for a printing apparatus, the method comprising;

printing, on a sheet, an image for one page or a plurality of pages;

storing, inside the printing apparatus, a sheet on which an image has been printed;

discharging, outside the printing apparatus, a sheet on which an image has been printed without storing the sheet;

saving, in a case where a sheet is not storable, data corresponding to a page to be printed on the sheet; and performing, upon receipt of a printed sheet taking-out instruction, control to convey a stored sheet so that at least a part of the sheet is exposed outside the printing apparatus, to print an image based on saved data, and to discharge, outside the printing apparatus, the sheet on which the image has been printed.

18. The non-transitory computer-readable storage medium according to claim 17, the method further comprising identifying a user, wherein performing control includes performing control to convey, from among stored sheets, a sheet corresponding to the identified user, and to print, from among saved data, data corresponding to the identified user.

19. The non-transitory computer-readable storage medium according to claim 17, the method further comprising notifying, before a stored sheet is conveyed to be partially exposed outside the printing apparatus, a user that a sheet is to be discharged.

20. The non-transitory computer-readable storage medium according to claim 17, the method further comprising holding a stored sheet in a state where only a part of the sheet is exposed outside of the printing apparatus, wherein, upon receipt of a printed sheet taking-out instruction, performing control includes performing control to convey the stored sheet stored to a position where the sheet is held.

* * * * *